United States Patent [19]

Dingle

[11] Patent Number: 5,040,497

[45] Date of Patent: Aug. 20, 1991

[54] ENGINE STARTING AID

[75] Inventor: Philip J. G. Dingle, Rochester, Mich.

[73] Assignee: Lucas Industries PLC, Birmingham, England

[21] Appl. No.: 474,530

[22] Filed: Feb. 2, 1990

[30] Foreign Application Priority Data

Feb. 1, 1989 [GB] United Kingdom ..... 8902129

[51] Int. Cl.[5] ..... F02N 17/00; F02M 31/00

[52] U.S. Cl. ..... 123/179 H; 123/298; 123/549

[58] Field of Search ..... 123/179 H, 297, 298, 123/549, 557

[56] References Cited

U.S. PATENT DOCUMENTS

| | | | |
|---|---|---|---|
| Re. 29,978 | 5/1979 | Leshner et al. | 123/297 |
| 4,648,361 | 3/1987 | Hales | 123/549 |
| 4,684,341 | 8/1987 | Kawamura et al. | 123/179 H |
| 4,760,818 | 8/1988 | Brooks et al. | 123/298 |
| 4,849,604 | 7/1989 | Woolcott | 123/179 H |
| 4,934,907 | 6/1990 | Kroner | 123/557 |

*Primary Examiner*—Andrew M. Dolinar
*Assistant Examiner*—Marguerite Macy
*Attorney, Agent, or Firm*—Leydig, Voit & Mayer

[57] ABSTRACT

A starting aid for a diesel engine comprises a housing (10) having a longitudinal passageway (12). Fuel is admitted to an upstream section (13) of the passageway via an inlet opening (14) and the fuel exits a downstream section (16) of the passageway via outlet openings (17). An electromagnetically-controlled plate valve (18) regulates a flow of fuel from the upstream, to the downstream section of the passageway, and a helical heater coil (32) heats the fuel as it passes along an annular part (31) of the downstream section (16) of the passageway (12).

6 Claims, 2 Drawing Sheets

ENGINE STARTING AID

BACKGROUND OF THE INVENTION

This invention relates to an engine starting aid, and it relates particularly, but not exclusively, to a starting aid suitable for a diesel engine.

Some known starting aids used, for example, in diesel engines exercise little, if any, control over the heat input to the engine during cranking and post heat situations. This can cause the engine to produce white exhaust smoke (unburnt fuel) and this is plainly wastful and environmentally undesirable.

SUMMARY OF THE INVENTION

According to the invention there is provided a starting aid for an engine comprising, a housing having a longitudinal passageway, an inlet by which fuel can be admitted to an upstream section of the passageway, an outlet by which fuel exits a downstream section of the passageway, an electromagnetically-controlled valve for regulating a flow of fuel from the upstream section of the passageway to the downstream section of the passageway, and heater means for heating fuel admitted to said downstream section of the passageway via said electro-magnetically-controlled valve so that vaporized fuel exits said outlet for ignition.

Said electromagnetically-controlled valve may be an electromagnetically-controlled plate valve.

The starting aid is particularly versatile in that the flow of fuel to the heater means can be accurately regulated by means of a control signal supplied to the electromagnet of the electromagnetically-controlled valve. Thus the input of heat to the engine is controlled giving a fast engine start and lower emission of white exhaust smoke.

Said downstream section of the passageway may, at least in part, be annular in transverse cross-section, and said heater means may comprise a helical heater coil disposed around said annular part of the passageway.

Preferably, an ignitor is connected in series with said heater coil for igniting vaporized fuel exiting said outlet.

The outlet may comprise one or more openings provided in the outer wall of said annular part of the passageway.

Said electromagnetically-controlled valve may be energised by a pulsed control signal supplied to the electromagnet of said electromagnetically-controlled valve and the pulsed control signal may be a variable width, fixed frequency pulsed control signal, or a variable frequency, fixed width pulsed control signal or a combination of both of these.

According to a further aspect of the invention, there is provided a starting aid for an engine comprising, a housing having a longitudinal passageway, an inlet by which fuel can be admitted to an upstream section of the passageway, an outlet by which fuel exits a downstream section of the passageway, an electromagnetically-controlled plate valve for regulating a flow of fuel from the upstream section of the passageway to the downstream section of the passageway, wherein the electromagnetically-controlled plate valve comprises an electromagnet and a valve, respective parts of the housing define a cavity containing the electromagnet, said parts being made of a magnetisable material and providing a magnetic circuit for the electromagnet, and the valve comprising an apertured valve seat and a valve plate which is made of a magnetisable material and is biassed resiliently against the valve seat to block the flow of fuel from the upstream section to the downstream section and is lifted away from the valve seat, in opposition to the resilient bias, by magnetic attraction of the electromagnet to permit the flow of fuel, and heater means for heating fuel admitted to the downstream section of the passageway via said electromagnetically-controlled plate valve so that vaporised fuel exits the outlet for ignition.

DESCRIPTION OF THE PREFERRED EMBODIMENT

Figure 1:
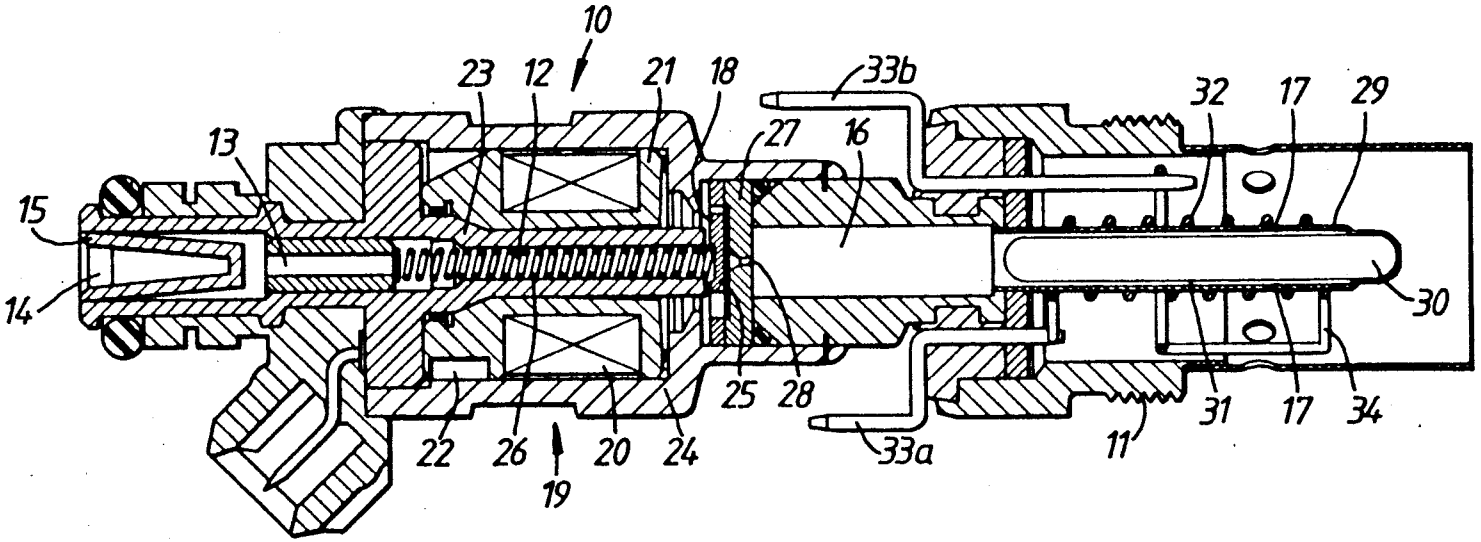
FIG. 1 shows a longitudinal, sectional view of a starting aid in accordance with the present invention.

Referring now to the drawings, the starting aid comprises a multi-part housing 10 having an externally, screw-threaded portion 11 by which the starting aid can be fitted into the inlet manifold of a diesel engine.

Figure 2:
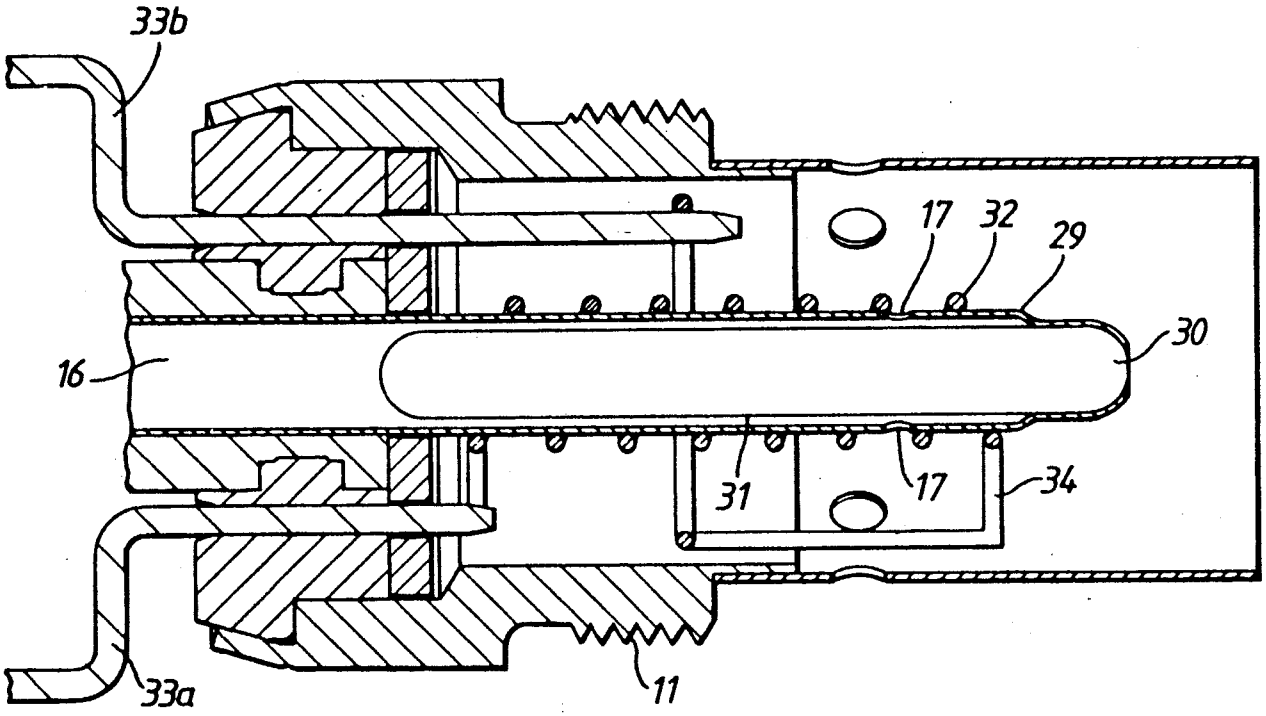
FIG. 2 shows a downstream part of the longitudinal sectional view of FIG. 1 on an enlarged scale.

The housing has a longitudinal passageway 12, fuel being admitted to an upstream section 13 of the passageway through an inlet 14, which is fitted with a fuel filter 15 of conventional design, and exiting a downstream section 16 of the Passageway through outlet openings 17 which are shown more clearly in FIG. 2.

A flow of fuel under pressure from the upstream section 13 of the passageway to the downstream section 16 of the passageway is regulated by means of an electro-magnetically-controlled valve 18. An electromagnet 19 associated with valve 18 comprises a solenoid coil 20 which is supported on a coil former 21 inside an annular cavity 22 defined by an inner part 23 of the housing and a concentric, outer part 24. Parts 23 and 24, which are both made of a magnetisable material, provide a magnetic circuit around the solenoid coil 20.

Valve 18 includes a valve plate 25, also made of a magnetisable material, which is biased by a coil spring 26 against a valve seat in the form of an apertured disc 27. In this manner the valve plate establishes a fluid-tight seal around aperture 28 in disc 27 and is thereby effective to block a flow of fuel from the upstream section of the passageway to the downstream section of the passageway.

Upon energisation of the solenoid coil 20 the valve plate is attracted magnetically towards the end face of part 23 and is lifted away from the valve seat. Fuel is then able to pass around the valve plate and can enter the downstream section of the passageway through aperture 28.

Upon de-energisation of the solenoid coil the magnetic attraction ceases and the valve plate is returned by spring 26 into sealing relation with the valve seat, thereby to block the flow of fuel.

The flow of fuel is accurately metered by suitable energisation of the electromagnetically-controlled valve and, to that end, the solenoid coil 20 may be supplied by a signal generator with a pulsed control signal which regulates the time intervals during which the solenoid coil is energised, and fuel can pass to the downstream section of the passageway, and the time intervals during which the solenoid coil is de-energised and fuel is prevented from passing to the downstream section of the passageway.

The mark-to-space ratio of the pulsed control signal supplied to the solenoid coil can be tailored to suit a desired operating schedule or characteristic commensurate with the prevailing ambient conditions and/or the condition of the engine. More specifically, the pulse control signal may be a variable width, fixed frequency pulsed control signal or a fixed pulse width, variable frequency pulsed control signal or a combination of both of these.

As is shown more clearly in FIG. 2 of the drawings, the downstream section of passageway 12 is formed, in part, by a thin-walled tube 29 fitted with a rod-like obturator 30. Tube 29 has a slightly larger diameter than that of the obturator and is sealed to the obturator at a position just downstream of the outlet openings 17. Thus, fuel which has been admitted to the downstream section of the passageway is constrained to approach the outlet openings along a relatively confined annular conduit 31 between the tube 29 and obturator 30.

A helical heater coil 32 is disposed around conduit 31, and an end of the coil 32 closer to the solenoid coil 20 is connected to a respective power supply lead 33*a*. The other end of the coil 32 is connected in series with an igniter coil 34 in the form of a conductive element extending radially from the tube 29 between outlet openings 17 an the end of the tube 29. The ignitor coil 34 is, in turn, connected to a second power supply lead 33*b*.

By this means the fuel in conduit 31 is heated, and exits the outlet openings 17 as a vapour, and since the conduit 31 can accommodate only a relatively small volume of fuel heat is transferred thereto very quickly and this assists the vaporisation. The vapour exiting the outlet openings 17 is ignited by the igniter coil 34, which is arranged to glow when in use. This produces a flame, the size and energy content of which is directly proportional to the mean fuel flow past the electromagnetically controlled valve. Heat is transferred to the induction air and thus to the combustion chambers.

A starting aid in accordance with the present invention is particularly suitable for starting a diesel engine from cold, and proves to be versatile in that the rate at which fuel is supplied to the heater can be varied in a controllable manner so as to match the prevailing engine conditions. For example, by supplying a suitable control signal to the electromagnetically-controlled valve the fuel flow rate may be maintained at a relatively low level initially, until ignition has been established, and the flow rate may then be increased gradually in accordance with a predetermined relationship to engine speed during both cranking and normal running, and thus may be used to reduce emission of white exhaust smoke from the engine due to cold operating conditions. The heater coil is also found to be effective in the role of incinerator/burner for exhaust particulate trap regeneration.

It will be appreciated that the electromagnetically controlled valve 18 described above with reference to the drawings may be replaced by any other suitable electromagnetically controlled valve. Further, the starting aid can be used with engines other than diesel engines.

I claim:

1. A starting aid for an engine comprising, a housing having a longitudinal passageway, an inlet by which fuel can be admitted to an upstream section of the passageway, an outlet by which fuel exits a downstream section of the passageway, an electromagnetically-controlled valve for regulating a flow of fuel from the upstream section of the passageway to the downstream section of the passageway, heater means for heating fuel admitted to said downstream section of the passageway via said electromagnetically-controlled valve so that vaporized fuel exits said outlet for ignition, and wherein the electromagnetically-controlled valve is energised with a pulsed control signal supplied to the electromagnet of the electromagnetically-controlled valve.

2. A starting aid as claimed in claim 1, wherein the pulsed control signal supplied to the electromagnet is a variable width, fixed-frequency pulsed control signal.

3. A starting aid as claimed in claim 1, wherein the pulsed control signal supplied to the electromagnet is a variable frequency, fixed-width pulsed control signal.

4. A starting aid as claimed in claim 1, wherein the pulsed control signal supplied to the electromagnet is a combination of variable width, fixed frequency and variable frequency, fixed width pulsed control signals.

5. A starting aid for an engine comprising, a housing having a longitudinal passageway, an inlet by which fuel can be admitted to an upstream section of the passageway, an outlet by which fuel exits a downstream section of the passageway, an electromagnetically-controlled plate valve for regulating a flow of fuel from the upstream section of the passageway to the downstream section of the passageway, wherein the electromagnetically-controlled plate valve comprises an electromagnet and a valve, respective parts of the housing define a cavity containing the electromagnet, said parts being made of a magnetisable material and providing a magnetic circuit for the electromagnet and the valve comprising an apertured valve seat and a valve plate which is made of a magnetisable material and is biassed resiliently against the valve seat to block the flow of fuel from the upstream section to the downstream section and is lifted away from the valve seat, in opposition to the resilient bias, by magnetic attraction of the electromagnet to permit the flow of fuel, and heater means for heating fuel admitted to the downstream section of the passageway via said electromagnetically-controlled plate valve so that vaporised fuel exits the outlet for ignition.

6. A starting aid as claimed in claim 5, including an igniter coil connected in series with said heater means for igniting vaporised fuel exiting said outlet.

* * * * *